US007752693B2

(12) United States Patent
Espenshade

(10) Patent No.: US 7,752,693 B2
(45) Date of Patent: Jul. 13, 2010

(54) MATTRESS STRUCTURE FOR CONTAINED CHILD PLAY AREA

(75) Inventor: Gregg R. Espenshade, Narvon, PA (US)

(73) Assignee: Graco Children's Products Inc., Atlanta, GA (US)

( * ) Notice: Subject to any disclaimer, the term of this patent is extended or adjusted under 35 U.S.C. 154(b) by 621 days.

(21) Appl. No.: 11/688,677

(22) Filed: Mar. 20, 2007

(65) Prior Publication Data

US 2007/0214576 A1 Sep. 20, 2007

Related U.S. Application Data

(60) Provisional application No. 60/784,028, filed on Mar. 20, 2006.

(51) Int. Cl.
*A47C 27/00* (2006.01)
*A47D 7/00* (2006.01)
*A47D 13/06* (2006.01)

(52) U.S. Cl. ..... 5/723; 5/691; 5/93.1; 5/99.1; 5/655

(58) Field of Classification Search ..... 5/723, 5/722, 727, 728, 691, 701, 99.1, 93.1, 655, 5/659

See application file for complete search history.

(56) References Cited

U.S. PATENT DOCUMENTS 2,974,325 A 3/1961 Mango
3,165,760 A * 1/1965 Abajian ..... 5/97
3,538,521 A * 11/1970 Basner ..... 5/691
3,777,321 A * 12/1973 Hargett ..... 5/99.1
3,924,280 A * 12/1975 Vaiano ..... 5/99.1
4,044,411 A * 8/1977 Peterson ..... 5/99.1
4,070,716 A * 1/1978 Satt et al. ..... 5/99.1
4,186,454 A 2/1980 Cone
4,336,621 A * 6/1982 Schwartz et al. ..... 5/658
4,476,594 A * 10/1984 McLeod ..... 5/701
4,483,026 A 11/1984 Kassai (Continued)

FOREIGN PATENT DOCUMENTS

EP 0 295 761 12/1988

(Continued)

OTHER PUBLICATIONS

Gershman, Maurice M.D. "Self-Adhering Nylon Tapes." Journal of A.M.A. (vol. 168, No. 7) Oct. 18, 1958.*

(Continued)

*Primary Examiner*—Robert G Santos
(74) *Attorney, Agent, or Firm*—Lempia Braidwood LLC

(57) ABSTRACT

A mattress assembly for a playard has a plurality of support panels coupled to one another and movable relative to one another. The support panels are movable between a generally planar in-use configuration having a top side and a bottom side and a multi-sided storage configuration with an interior space sized to surround a collapsed playard. A mattress pad is detachable from and attachable to the plurality of support panels. The mattress pad lies against the top side of the plurality of support panels and is movable with the plurality of support panels between the in-use configuration and the storage configuration. A plurality of attachment devices are provided for selectively attaching the mattress pad to and detaching the mattress pad from the plurality of support panels.

20 Claims, 11 Drawing Sheets

U.S. PATENT DOCUMENTS

| | | | | | |
|---|---|---|---|---|---|
| 4,683,600 | A | | 8/1987 | Beger | |
| 4,739,527 | A | | 4/1988 | Kohus et al. | |
| 4,750,223 | A | * | 6/1988 | D'Arcy et al. | 5/99.1 |
| RE32,734 | E | * | 8/1988 | McLeod | 5/722 |
| 4,811,437 | A | * | 3/1989 | Dillner et al. | 5/99.1 |
| 4,815,155 | A | * | 3/1989 | Sommers | 5/659 |
| 4,837,875 | A | * | 6/1989 | Shamie et al. | 5/99.1 |
| 4,862,537 | A | * | 9/1989 | Riley | 5/659 |
| 4,930,170 | A | * | 6/1990 | Kobayashi | 5/12.1 |
| 4,967,432 | A | | 11/1990 | Kujawski | |
| 5,197,154 | A | * | 3/1993 | Shamie | 5/99.1 |
| 5,241,716 | A | | 9/1993 | Kohus | |
| 5,243,718 | A | * | 9/1993 | Shamie | 5/99.1 |
| 5,293,656 | A | * | 3/1994 | Chan | 5/99.1 |
| 5,381,570 | A | * | 1/1995 | Cheng | 5/99.1 |
| 5,384,925 | A | | 1/1995 | Vail | |
| 5,483,710 | A | * | 1/1996 | Chan | 5/99.1 |
| 5,697,111 | A | * | 12/1997 | Dillner et al. | 5/99.1 |
| 5,711,040 | A | | 1/1998 | Huang | |
| 5,826,285 | A | * | 10/1998 | Mariol et al. | 5/99.1 |
| 5,867,851 | A | * | 2/1999 | Mariol et al. | 5/99.1 |
| 6,058,528 | A | | 5/2000 | Yang | |
| 6,067,676 | A | | 5/2000 | Carnahan et al. | |
| 6,123,091 | A | * | 9/2000 | Flynn et al. | 135/96 |
| 6,148,456 | A | * | 11/2000 | Tharalson et al. | 5/99.1 |
| 6,250,837 | B1 | * | 6/2001 | Mariol et al. | 403/102 |
| 6,421,850 | B1 | | 7/2002 | Welsh, Jr. | |
| 6,438,773 | B1 | | 8/2002 | Hsia | |
| 6,510,570 | B2 | * | 1/2003 | Hartenstine et al. | 5/99.1 |
| 6,588,033 | B1 | * | 7/2003 | Welsh et al. | 5/99.1 |
| 6,678,908 | B2 | * | 1/2004 | Borders et al. | 5/691 |
| 6,865,756 | B2 | | 3/2005 | Clapper et al. | |
| 6,907,626 | B1 | * | 6/2005 | Welsh et al. | 5/99.1 |
| 7,013,505 | B2 | * | 3/2006 | Martin | 5/95 |
| 7,287,289 | B1 | * | 10/2007 | Hagopian | 5/600 |
| 7,568,242 | B2 | * | 8/2009 | Troutman | 5/99.1 |
| 2001/0044971 | A1 | * | 11/2001 | Borders et al. | 5/691 |
| 2002/0070532 | A1 | | 6/2002 | Harrison et al. | |
| 2004/0143904 | A1 | * | 7/2004 | Borders et al. | 5/600 |
| 2005/0034232 | A1 | * | 2/2005 | Martin | 5/95 |
| 2007/0214576 | A1 | * | 9/2007 | Espenshade | 5/723 |

FOREIGN PATENT DOCUMENTS

| | | |
|---|---|---|
| FR | 1053010 | 1/1954 |
| FR | 2361846 | 3/1978 |
| FR | 2769815 | 4/1999 |

OTHER PUBLICATIONS

Product literature for Evenflo Houdini playpen, 2 pages.

Owner's Manual for Graco Children's Products Inc. Pack N Play Sport playpen.

Product literature including 1 web page and 1 photograph, and instruction manual pp. 1 and 37 for Chicco Lullaby Playard from www.chiccousa.com.

International Search Report and Written Opinion from related International application PCT/US2007/064374 mailed Sep. 4, 2007.

* cited by examiner

MATTRESS STRUCTURE FOR CONTAINED CHILD PLAY AREA

RELATED APPLICATION DATA

This patent is related to and claims priority benefit of prior filed U.S. Provisional Application Ser. No. 60/784,028, which was filed on Mar. 20, 2006 and was entitled "Contained Child Play Area."

BACKGROUND OF THE INVENTION

1. Field of the Invention

The present invention is generally directed to playards and other contained child play area products, and more particularly to a mattress or pad structure for use within such a playard, playpen, portable crib, and the like.

2. Description of Related Art

Playards, playpens, portable cribs, and the like can be quite heavy, cumbersome, and difficult to fold, especially in light of the accessories now available that can be attached to such products. Many of these types of products, and particularly playards, exist on the market today with contained sleeping and/or play spaces that can be converted or enhanced to some degree with add-on features. These conversion features include a bassinet or elevated infant sleep area and/or an infant changing table or surface. When it is desired to fold or collapse the structure, many of the add-on features typically either fold with the units or are removed from, but stored with, the collapsed units. This can add significant weight and size to the products.

There are many playards and other such products on the market today that are labeled or marketed as portable units. However, most of these products do not truly offer a light weight, fast-fold unit, with easily portable accessories. Additionally, a conventional mattress for these types of products must be transported with the units. The mattress structure typically has a plurality of panels made from a sturdy but heavy material. The panels are sewn into the fabric mattress cover along with other mattress materials and are thus typically not removable. As a result, the typical mattress can be quite heavy. On many of these types of units, the mattress can fold to surround the exterior of the collapsed frame assembly of the product and in this way is portable with the unit. The relatively heavy mattress adds additional weight to the portable unit.

A typical pad or mattress is formed using an outer fabric layer of material selected based on decoration, durability, wear resistance, stain resistance, comfort, and/or the like. A pad or cushion material is provided beneath the outer layer. The base or structural panel material is provided within the pad or mattress for rigidity and for supporting the weight of a child user. The base material is typically made from a solid or composite material such as particle board or wood and can be relatively heavy. The cover or outer layer is typically not removable. Thus, in addition to the panels being relatively heavy and not removable, the mattress also can not be taken apart to change or clean the outer covering because the typical mattress is a sewn together product.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Mattress assembly examples are disclosed and described herein that solve or improve upon one or more of the above-noted and other problems and disadvantages with prior known mattress structures. In one example, a disclosed mattress assembly is a lightweight product with a sturdy support structure and a detachable mattress pad. The support structure and pad can be assembled and folded to a configuration to surround a collapsed playard as is known in the art. The mattress pad can be easily removed from the support structure so that it can be cleaned and replaced on the support structure, or even selectively interchanged with an alternate mattress pad.

Figure 1:
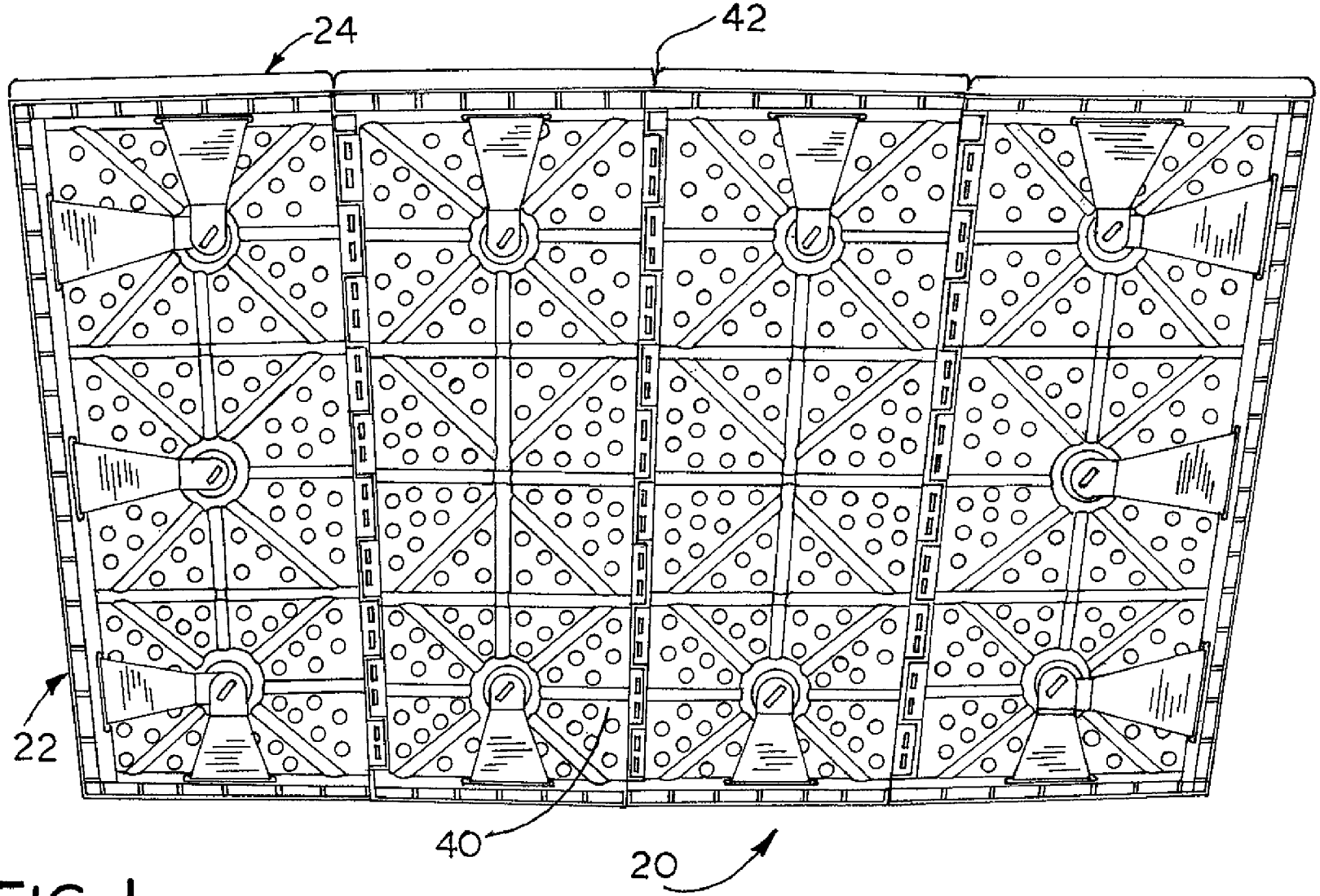
FIG. 1 shows a bottom perspective view of a mattress assembly for a product that provides a contained child play and/or sleep area and that is constructed in accordance with the teachings of the present invention.

Turning now to the drawings, FIG. 1 is a perspective bottom view of a mattress assembly 20 constructed in accordance with the teachings of the present invention. The mattress assembly 20 in the disclosed example includes a multi-piece support structure 22 and a mattress pad 24 detachably coupled to the support structure. The specific features of the mattress assembly 20 are described in greater detail below. The mattress assembly 20 disclosed herein is suitable for use in products that offer a contained child play or sleep area, and is particularly well suited for a product where the mattress is to be removed so that the product can be collapsed. Clearly, the mattress assembly 20 disclosed herein can be used for other products requiring a mattress, but is particularly well suited for products where the mattress be removable and where the products are intended to be portable.

Figure 2:
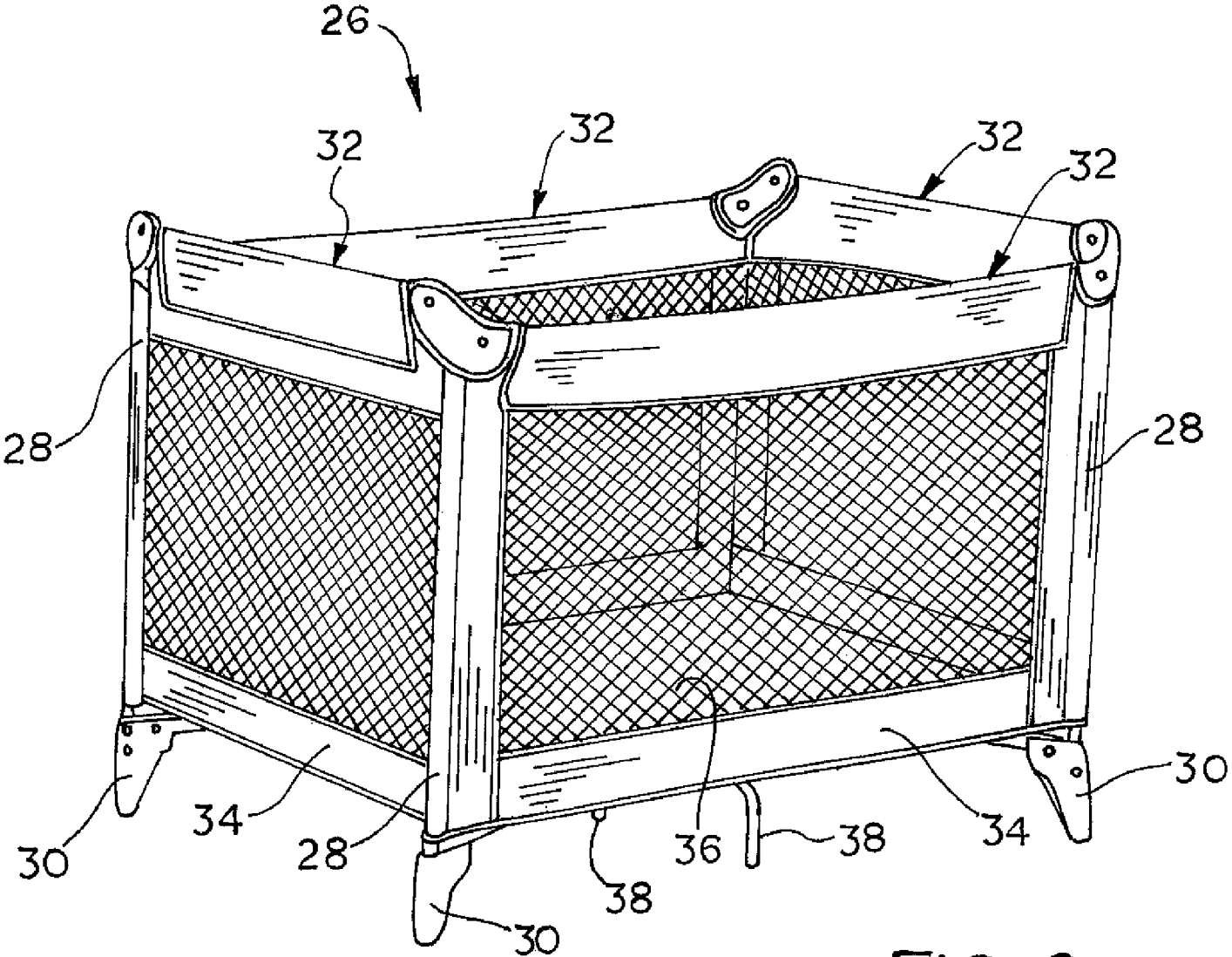
FIG. 2 shows a perspective view of a playard suitable for use in conjunction with the mattress assembly shown in FIG. 1.

One type of product that utilizes this type of mattress is configured to create a contained child play area and is commonly known as a playard. A generically configured, well-known playard 26, other than the removable mattress assembly 20 of the invention, is illustrated in FIG. 2. As is known in the art, the ordinary playard 26 typically includes a bottom frame structure (not shown) that interconnects four corner legs 28. The corner legs 28 are supported on a ground surface by corresponding feet 30. The corner legs 28 are typically interconnected both by the bottom frame structure and a plurality of top links 32 that extend between the top ends of the legs 28. In this example, the top links 32 are covered by a suspended, overlapping fabric.

Figure 3:
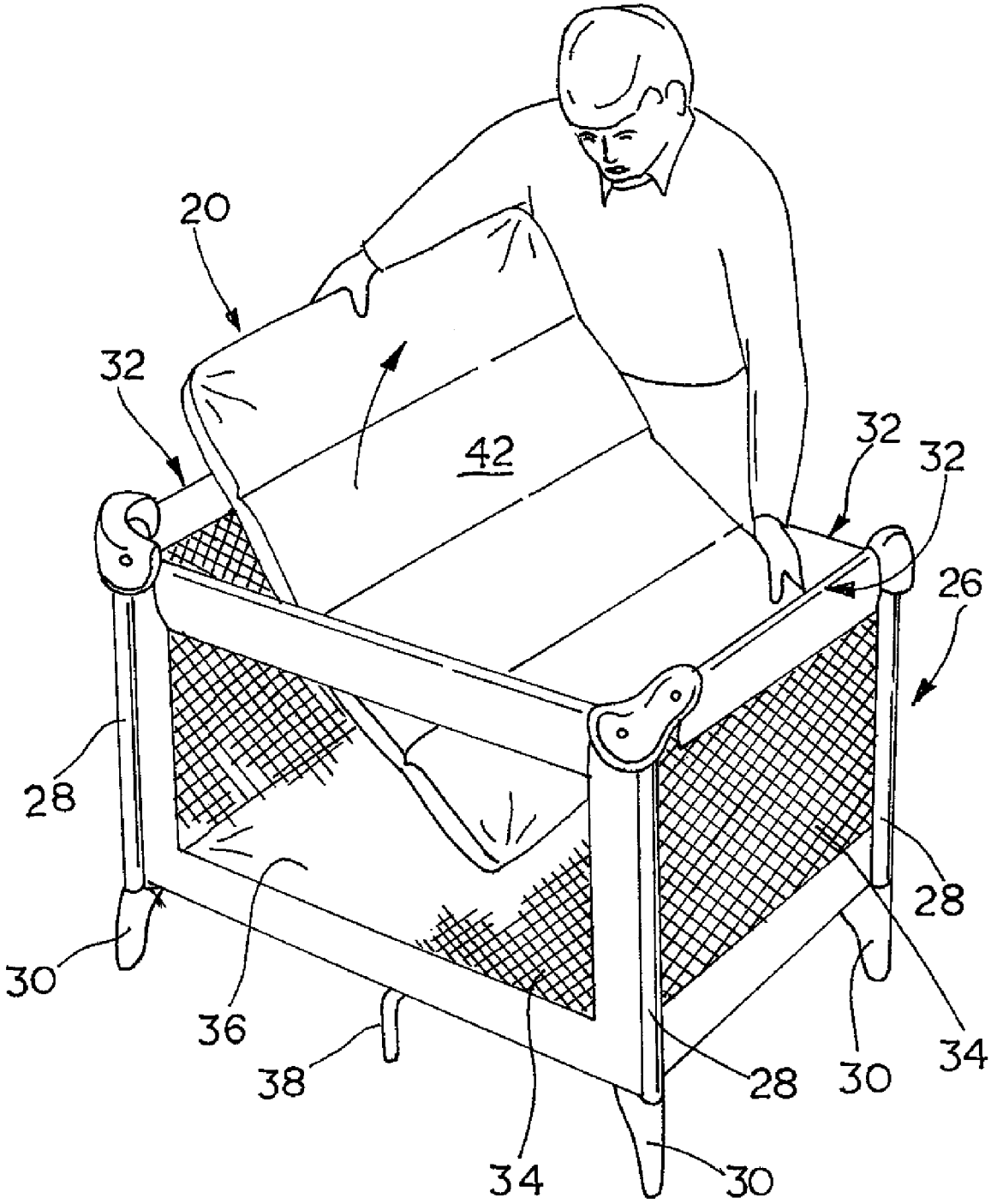
FIG. 3 shows the mattress assembly of FIG. 1 as it is being removed from the playard.

The conventional playard 26 also has a side wall and a bottom as shown in FIG. 2. In this example, the legs 28 are interconnected by fabric, nylon, or mesh side panels 34 that form the side wall. The side panels 34, in conjunction with a bottom panel 36, define the fabric enclosure or contained area. In the typical playard 26, the bottom panel 36 is a flimsy fabric layer suspended and/or supported above the ground surface by the bottom frame (not shown). The typical bottom panel 36 does not offer much actual support for an occupant of the playard. Instead, a mattress assembly is typically received within the contained area of the playard, rests on the bottom panel 36, and is usually supported by the bottom frame structure above the ground surface. The mattress structure itself typically provides the firm support for an occupant of the playard. The mattress is removable from and insertable into the playard 26, as shown in FIG. 3. Often, the bottom frame structure includes one or more additional downward projecting feet 38. The feet 38 can provide additional stability and support with the frame structure in the in-use configuration depicted in FIGS. 2 and 3.

A conventional mattress in this type of playard typically has a plurality of sections foldable relative to one another but interconnected with one another. Each section typically has a substantially rigid panel adjacent padding or cushion material, and may have an inner liner material, as well. Each component is sewn within an outer layer of material. The sections are sewn together within the outer liner material to form an integral mattress structure that is not intended to be broken down. Thus, the panels, inner material layers, and padding of a conventional mattress can not be removed from the outer fabric layer.

Figure 4:
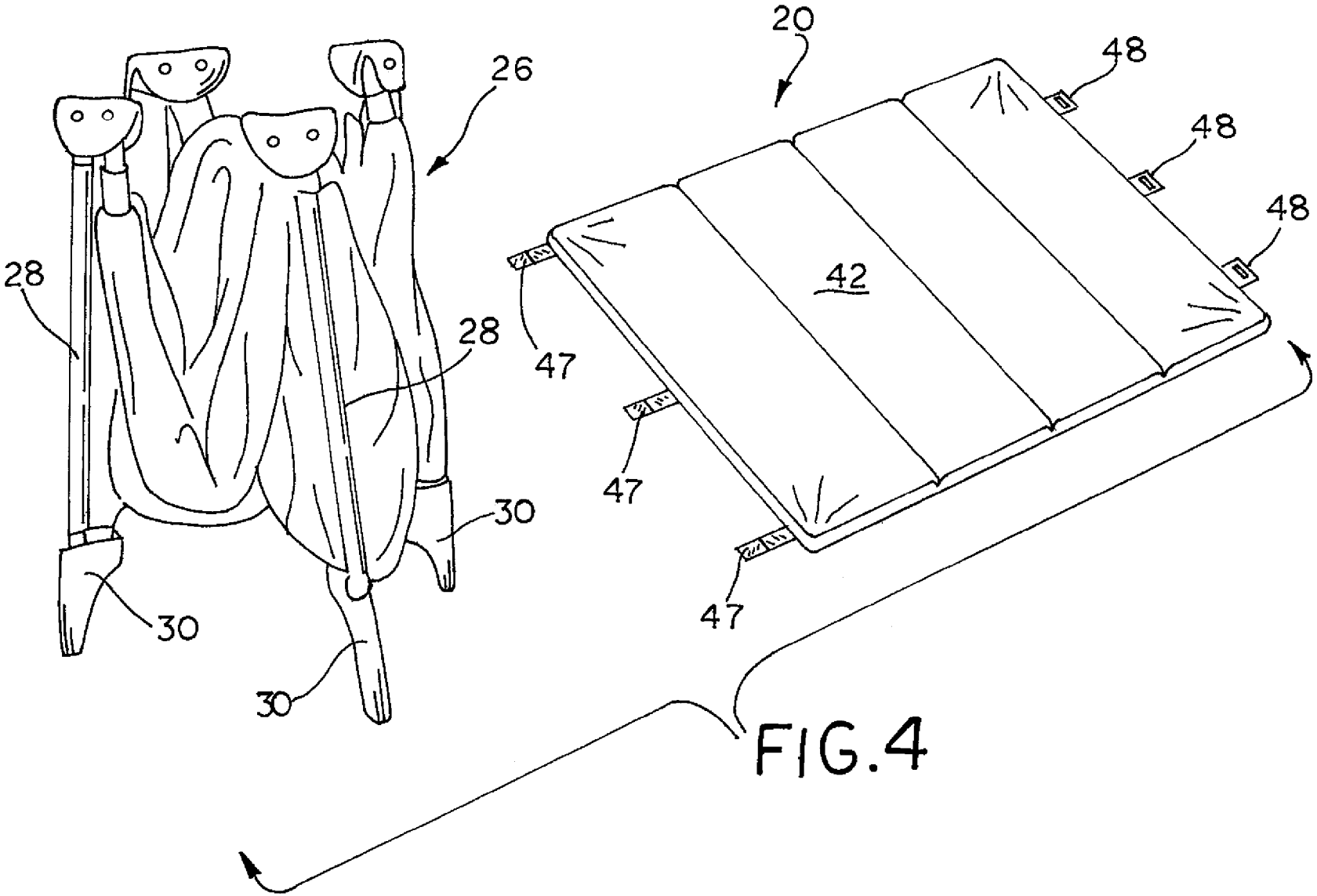
FIG. 4 shows the playard of FIG. 2 in a near folded configuration and a top perspective view of the removed mattress assembly of FIG. 1.

Without going into any particular detail, the typical playard 26 is foldable to a collapsed, portable configuration. The top links 32 and bottom frame (not shown) can fold upward or downward and inward bringing the four legs 28 closer together and generally parallel to one another as depicted in FIG. 4. There are a variety of playard or playpen constructions known in the art that fold in this manner. The details of the fold configuration, latching components, and structural arrangement of the components can vary without effecting the scope and spirit of the present invention. Thus, such details are not described and disclosed herein. As shown in FIGS. 3 and 4, the mattress assembly 20 of the present invention can also be removed from the playard prior to collapsing the playard structure. As is known in the art, a typical mattress can be folded to form a rectangular tube or cylinder sized to surround the collapsed playard structure. The mattress assembly 20 disclosed herein can accomplish this same function.

Figure 5A:
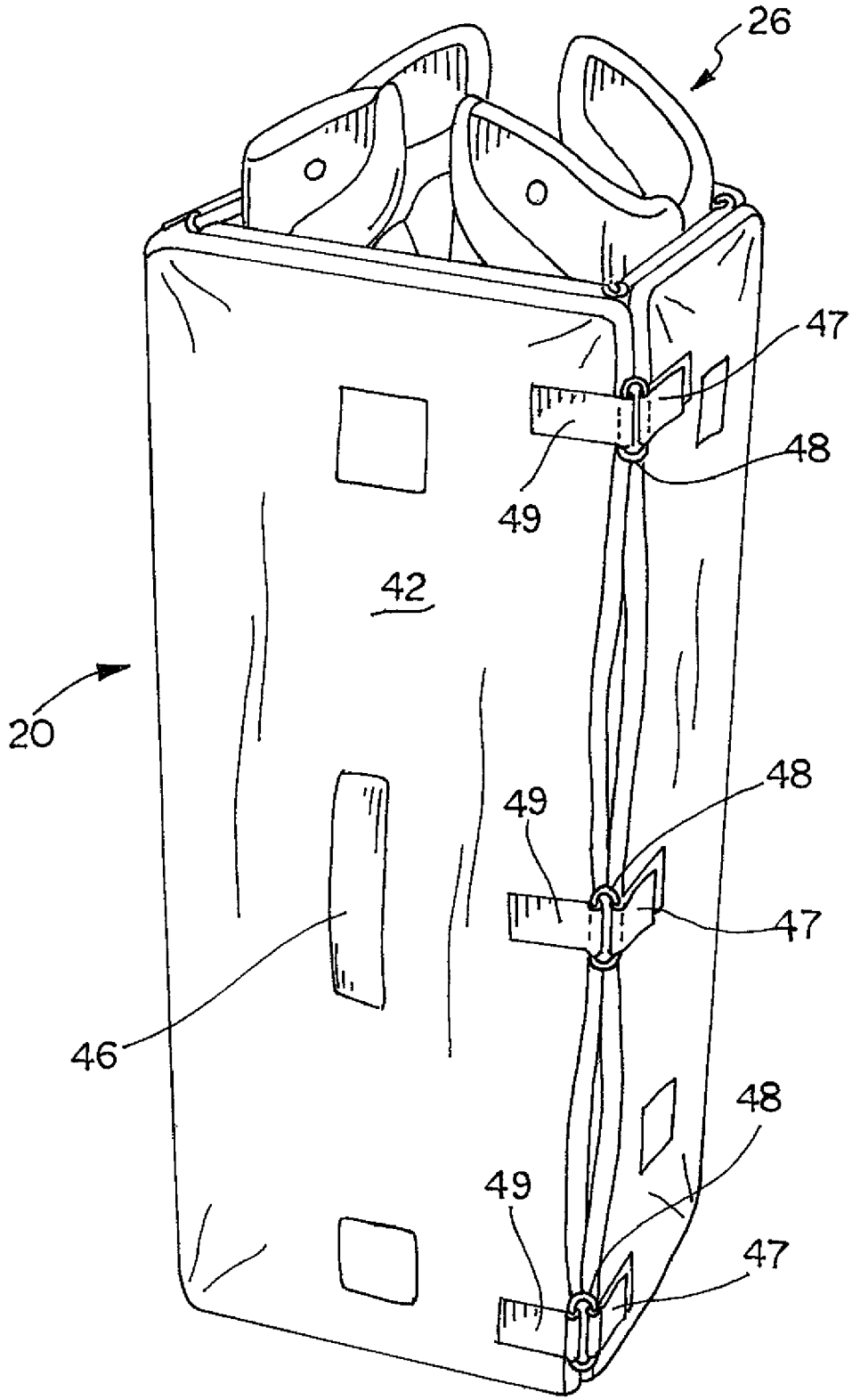
FIG. 5A shows the playard of FIG. 2 in a completely folded configuration with the mattress assembly folded around and surrounding the playard in a first mattress orientation.
Figure 5B:
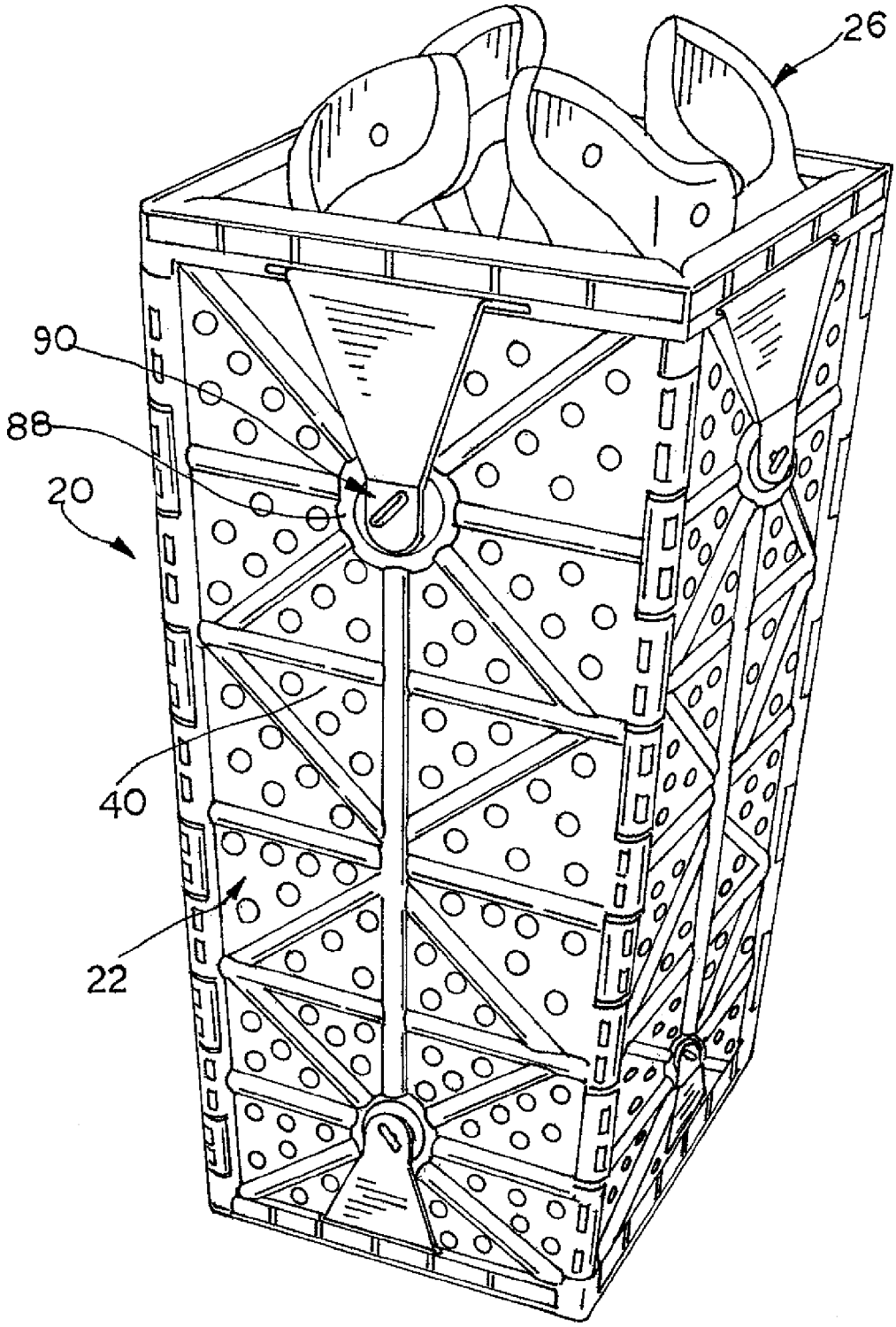
FIG. 5B shows the playard of FIG. 2 in a completely folded configuration with the mattress assembly folded around and surrounding the playard in a second mattress orientation.
Figure 6:
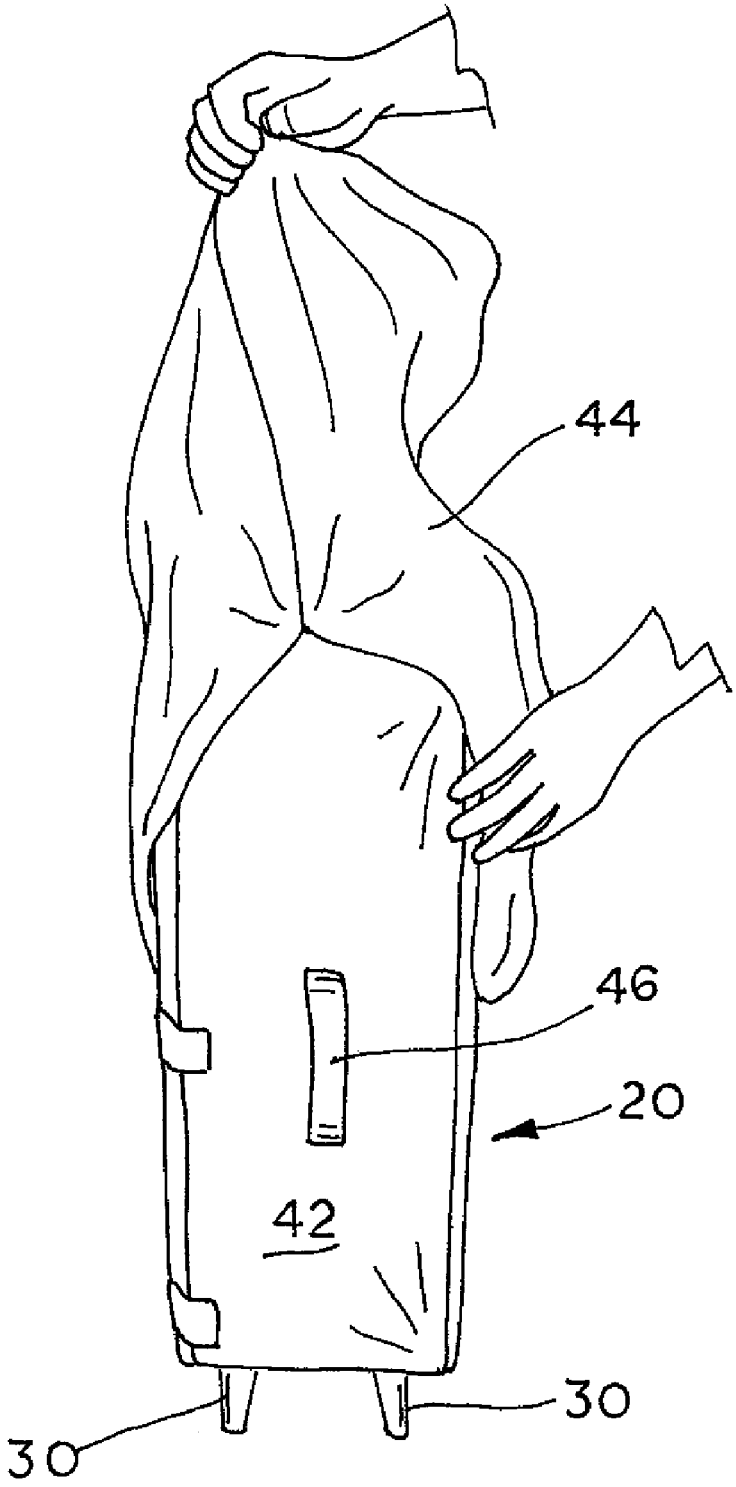
FIG. 6 shows the folded playard of FIG. 5A being inserted into a storage bag.

As shown in FIGS. 5A and 5B, the mattress assembly 20 disclosed and described herein can be folded into a four sided rectangular tube or cylinder configuration. Either a bottom surface 40 or a top surface 42 can be exposed to the exterior of the folded and assembled product and yet fall within the spirit and scope of the present invention. The collapsed playard 26, with the top surface 42 facing out and the bottom surface 40 on the interior of the folded mattress assembly 20, provides an easily transportable product configuration. As depicted in FIG. 6, this folded and collapsed assembly can be stored in a bag 44. In one example, the bag 44 can be provided with a carry handle. Alternatively, as shown in this example a surface of the playard mattress assembly 20, such as the top surface 42, can be provided with a handle 46. The handle 46 can extend through an opening in the exterior bag 44, if such a bag is provided.

A plurality of fastening or latching devices can be formed on edges of the mattress as depicted in FIGS. 5 and 6, for example, in order to assist in retaining the folded mattress assembly 20 in the folded configuration surrounding the collapsed playard structure 26. In one example, a plurality of straps 47 with hook and loop fastener material can be provided extending from one edge of the mattress. Loops 48 can be sewn or otherwise secured via straps 49 on the opposite edge of the mattress. When the mattress assembly 20 is folded around the exterior of the collapsed playard structure, the hook and loop fastener straps 47 on one edge of the mattress can be threaded through the loops 48 and secured in place. Alternatively, straps can be provided on one edge of the mattress assembly with one part of a hook and look fastener material. A strip of the mating part of the hook and loop fastener material can be provided on the opposite edge of the mattress assembly. The straps can be attached to the mating hook and loop fastener material to assist in securely holding the mattress in place surrounding the collapsed playard. Other types of fastening or latching devices can also certainly be employed within the spirit and scope of the present invention, such as buckles, clamps, and the like.

Figure 7:
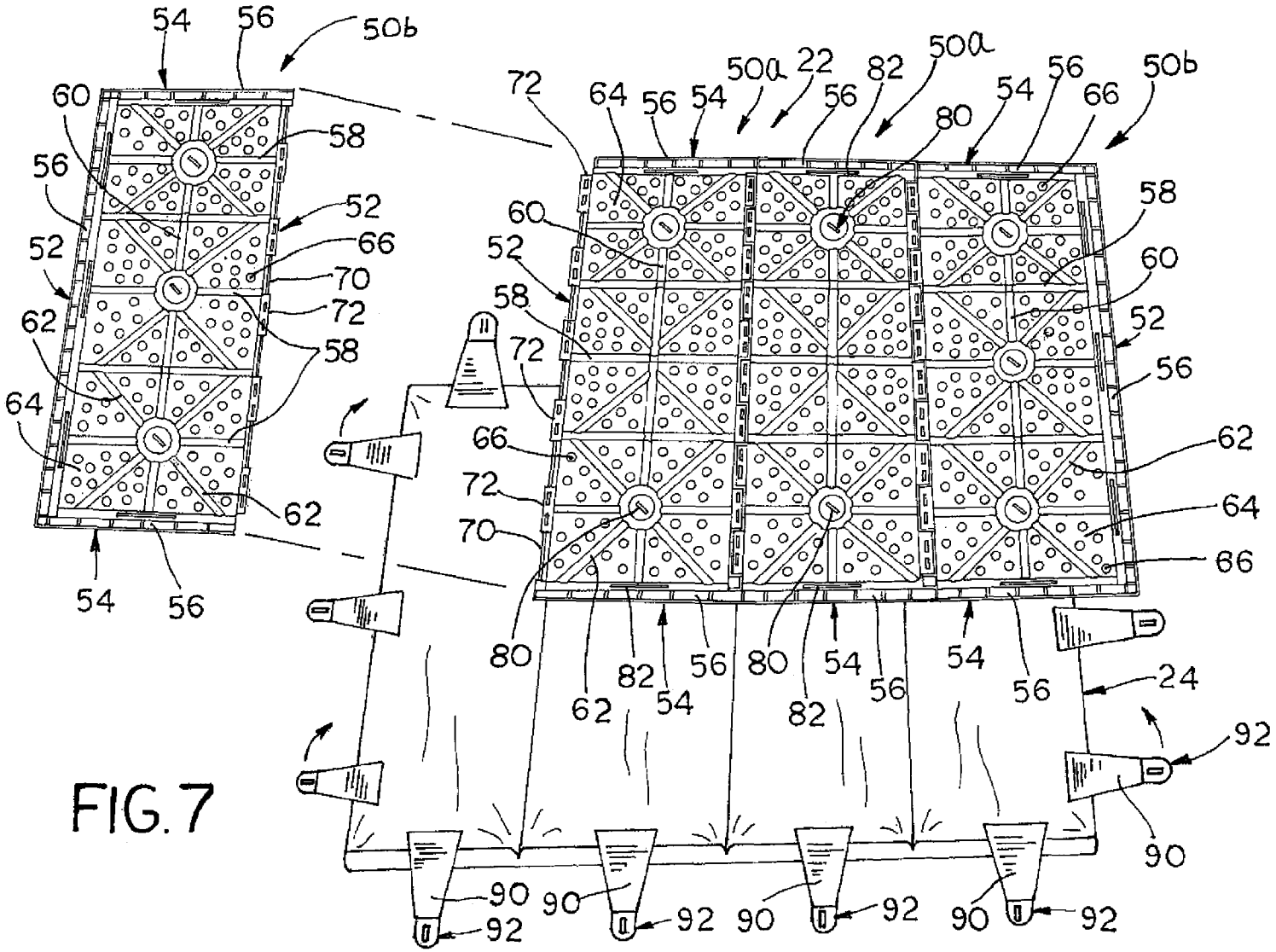
FIG. 7 shows an exploded view of the mattress assembly shown in FIG. 1.
Figure 8:
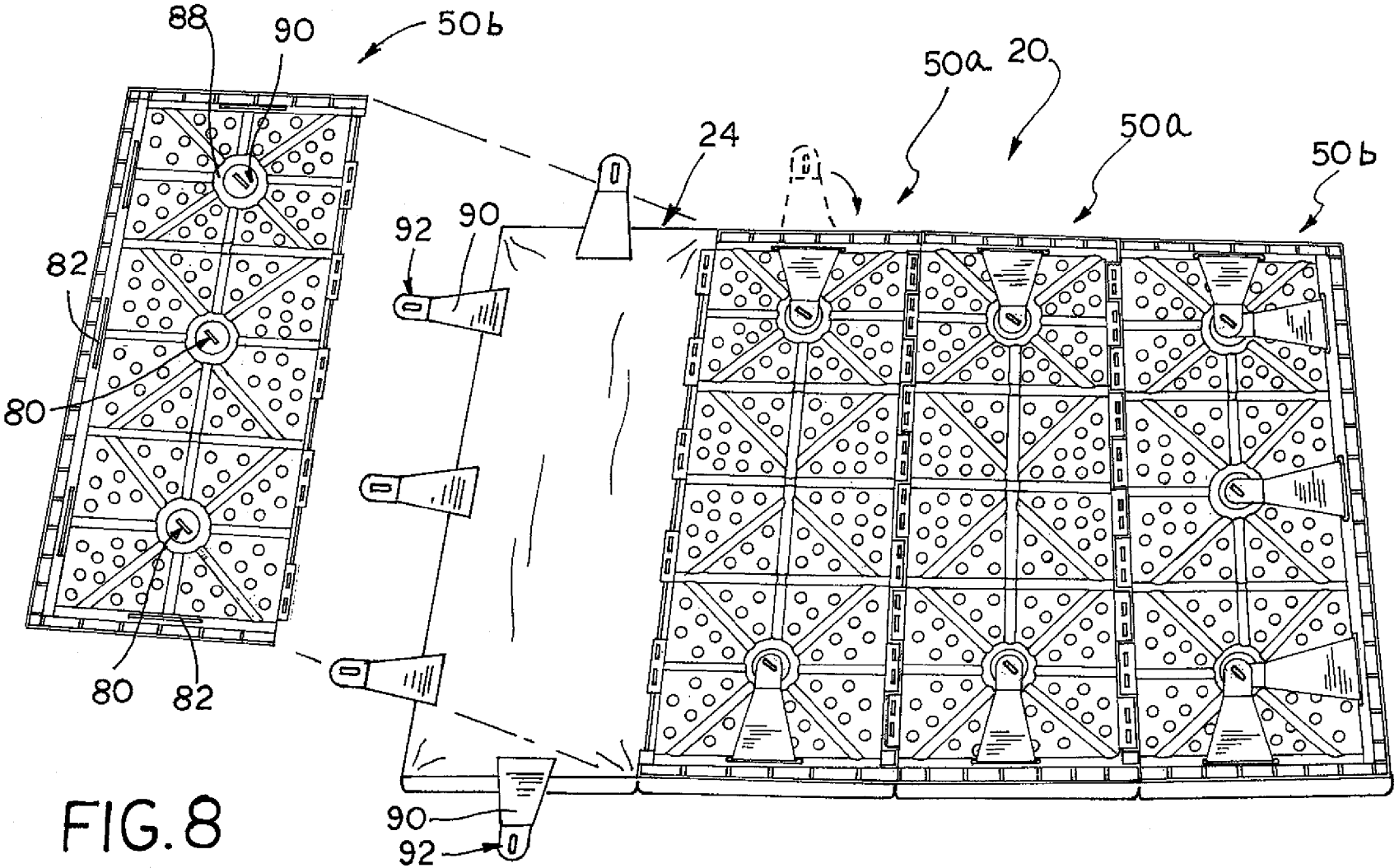
FIG. 8 shows the mattress assembly of FIG. 7 in a partly assembled condition.

FIGS. 7-10 show one example of the mattress assembly 20 constructed in accordance with the teachings of the present invention. FIG. 7 shows a partially exploded view and FIG. 8 shows a partially assembled view of the mattress assembly 20, both views being from the bottom. The support structure 22 of the mattress assembly 20 has four plastic molded panel sections including two inner or interior panels 50*a* and two outer panels 50*b* in this example. The panel sections 50*a* and 50*b* in the disclosed example each are formed as elongate rectangular panels with a pair of opposed long sides 52 and a pair of opposed shorter ends 54. The edges of each panel 50*a* and 50*b* in the disclosed example include a perimeter rib or structural channel 56 along the long sides 52 and short sides 54 for strength and rigidity. Each panel section 50*a* and 50*b* also includes a plurality of traversing ribs or channels 58 that extend laterally between the long sides 52. A centrally disposed rib or channel 60 is positioned at a mid-point between the long sides and extends longitudinally between the shorter ends 54. Each of the traversing ribs 58 and longitudinal ribs 60 of the panels 50*a* and 50*b* in the disclosed example provide additional structural rigidity for the respective panel.

In the disclosed example, a plurality of diagonal ribs or channels 62 is also provided on each panel section 50*a* and 50*b*. The diagonal ribs 62 extend diagonally between the longitudinal rib 60, the traversing ribs 58, and the perimeter rib 56 on each panel to add further structural rigidity and strength. As will be evident to those having ordinary skill in the art, the configuration, number, orientation, and arrangement of the various ribs or stiffening structures of each panel can vary considerably and yet fall within the spirit and scope of the present invention. The various ribs or channels in the disclosed example have a width and depth to increase their strength. The panel sections when connected will underlie and define the sleeping or playing surface for the product, such as the above-described playard 26, into which the mattress assembly 20 is placed.

A support surface 64 interconnects and extends between the various ribs or channels and defines the primary surface structure of each panel section 50*a* and 50*b*. In this example, the support surface 64 is perforate and has a plurality of holes 66 or cutouts. These perforations can reduce the weight of the panel sections, save on material usage, and can add breatheability or ventilation to the overall mattress structure without affecting the structural integrity. The number, arrangement, size, and shape of the perforations, if provided, can also vary and yet fall within the spirit and scope of the present invention. In the disclosed example, the panel sections 50*a* and 50*b* can be formed from a lightweight plastic material, a thermoplastic material, a plastic or other composite material or the like. The panel sections can be injection molded or otherwise suitably manufactured. Thus, the support panel material and manufacturing process can vary within the spirit and scope of the present invention.

Also in the disclosed example, each of the panel sections 50*a* and 50*b* includes a plurality of hinge components arranged along their respective edges. As will be evident to those having ordinary skill in the art, the panel sections 50*a* and 50*b* can each be created as identical panels interchangeable with one or another, whether all of the components of each panel are used or not, depending on their position in the assembled structure. In the disclosed example, the two interior panel sections 50*a* are identical to one another and hingedly connected to one another and two end panel sections 50*b* are identical to one another and hingedly connected to the interior panels. However, in this example, the end panel sections 50*b* are different from the interior panels 50*a*.

Figure 9:
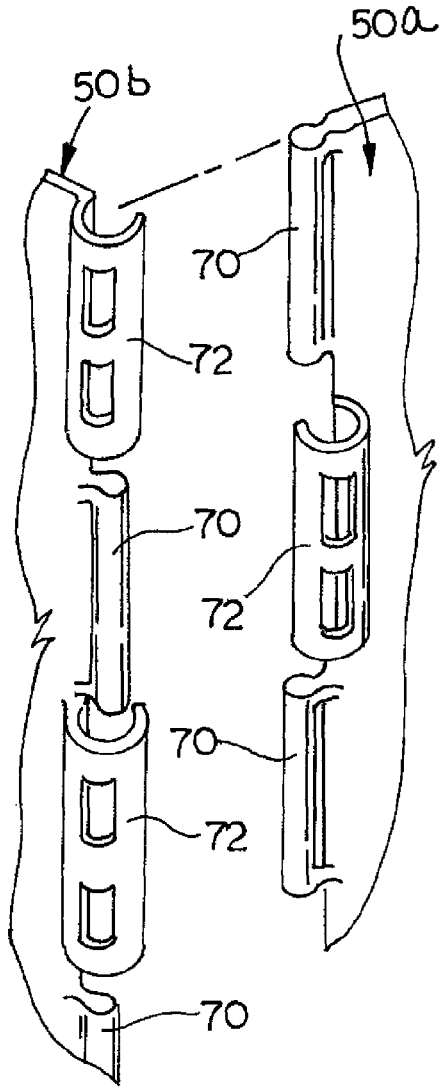
FIG. 9 shows an enlarged view of a portion of the support panel sections of the exploded mattress assembly shown in FIG. 7.
Figure 10:
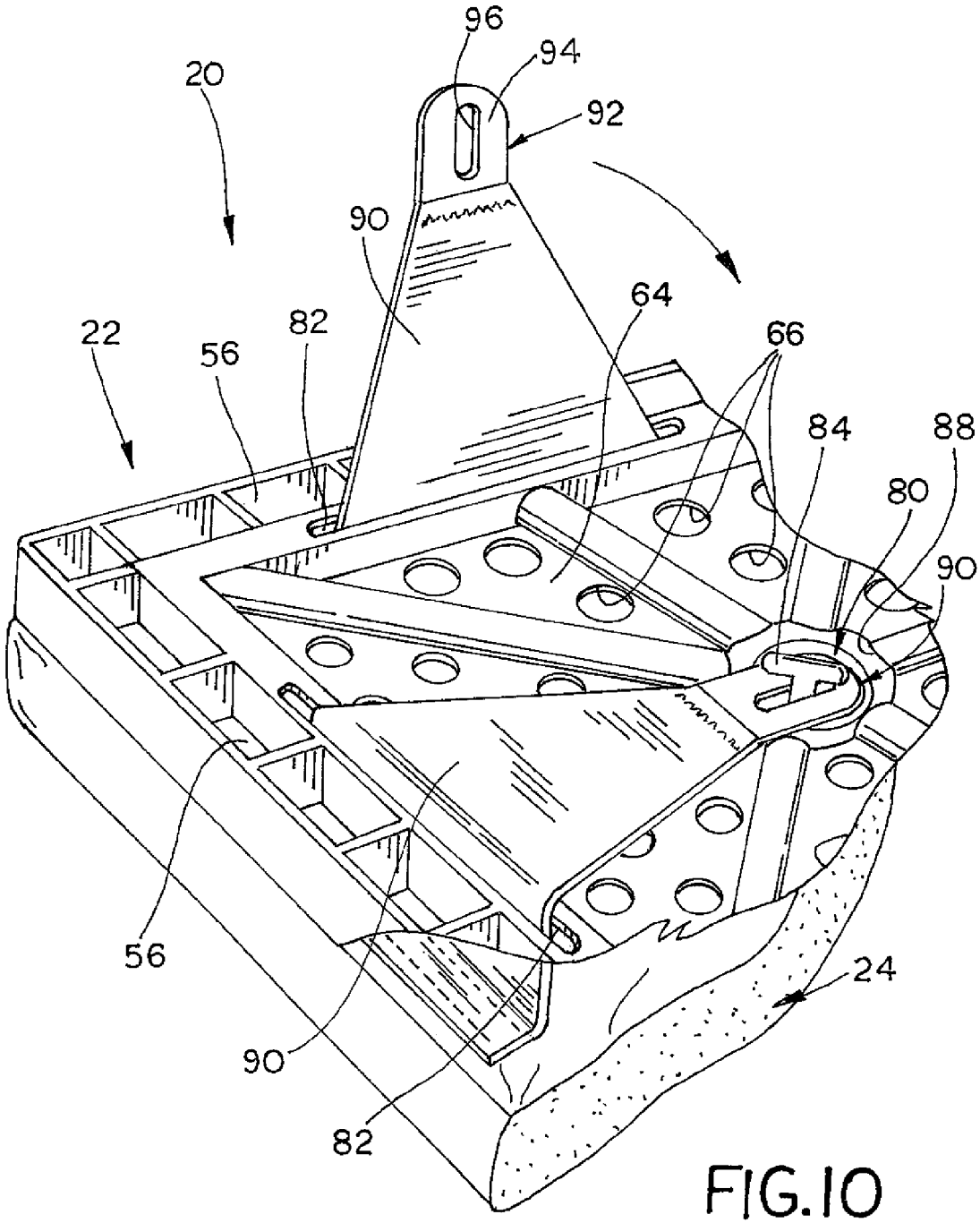
FIG. 10 shows an enlarged view of a portion of the mattress assembly in FIG. 7 and showing one example of a detachable connection device for attaching the mattress pad to the underlying support structure.

In the disclosed example as shown in FIGS. 7-9, the interior panels 50*a* each have a plurality of hinge components carried on the long sides 52 integrally molded or formed as part of the panel sections. The hinge components include hinge pins 70 and hinge knuckles 72 alternately spaced along each of the long sides 52. Each hinge pin 70 is formed standing off the edge of the side 52. Each knuckle 72 is in the form of an elongate hook sized to receive or snap onto a corresponding pin 70 on an adjacent panel section. As best shown in FIGS. 8 and 9, the pins 70 and knuckles 72 on one edge of the panel alternate positionally with the pins 70 and knuckles 72 on the opposite edge of the panel section. Thus, one panel section can be attached to another identical panel section by snapping the pins 70 in corresponding barrels 72 on the adjacent panel. The pins 70 stand off the edge of the panel section to permit rotation of the knuckles 72 around the pins. Thus, the panel sections 50*a* and 50*b* can be pivoted relative to one another at least 90 degrees in either direction in this example to achieve the alternate folded configurations shown in FIGS. 5A and 5AB.

As shown in FIGS. 7 and 8, each of the end panels 50*b* in this example include alternating hinge pins 70 and knuckles 72 along only one side edge or long side 52. In this example, the opposite long side 52 is generally smooth and includes no hinge components since the exterior edge will not attach to an adjacent panel. Each end panel 50*b* will attach to one exposed edge of the connected interior panels 50*a* in a similar manner by connecting the pins to the knuckles to create the assembled hinge connection.

As will be evident to those having ordinary skill in the art, the hinge components can vary considerably and yet fall within the spirit and scope of the present invention as well. With four such panel sections 50*a* and 50*b*, the mattress assembly 20 can be folded at each of the joints to a 90 degree angle between adjacent joints to fit around the folded or collapsed playard unit 26. The support structure and panel sections can be designed to include pivot travel limiters, overcenter cams, detents, or other features at the hinges. Such features can be employed to create desired fold characteristics in the mattress assembly 20, such as to lock the assembly in a flat or planar configuration and/or in the folded configuration. With such a feature, when the mattress is opened up to lie flat, the mattress sections will resist pivoting when in use. This can prevent a child from being able to lift or raise a portion of the mattress during use. In one alternative example, the support structure can be designed with hinged or pivoting connections between panel sections so that the entire support structure can fold unto itself to the size of one panel, similar to bi-fold doors.

The joint or hinge construction can vary considerably and yet provide the desired function. FIGS. 7-9 illustrate just one of many possible examples. The panel sections 50*a* and 50*b* should be capable of rotation or pivoting relative to one another, or otherwise be movable or bendable relative to one another so that the mattress can be folded as required for either storage or to form a rectangular tube around a collapsed playard. An integral living hinge connection between panel sections or other types of detachable connections between the panels sections are permissible.

Figure 11:
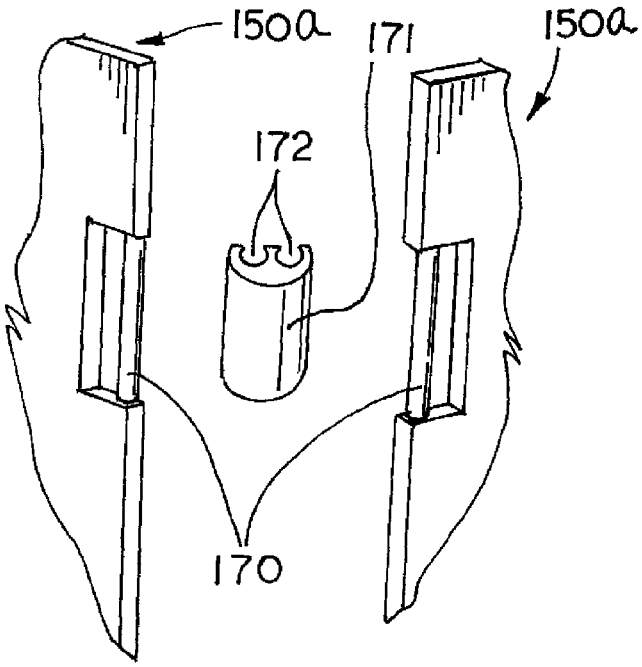
FIG. 11 shows an enlarged exploded view of portions of a mattress support structure with an alternative pivotal attachment constructed in accordance with the teachings of the present invention.

FIG. 11 shows one alternative hinge or pivot joint construction that can be employed to interconnect the panel sections. In this example, side edges of adjacent panel sections 150*a* can each include a plurality of hinge pins 170. A discrete coupling or connector 171 that includes a pair of parallel pin receptacles or knuckles 172. The connector can be snapped onto adjacent pins 170 of the two panels 150*a* to interconnect the panels. Two or more of this type of connections or joints can be employed on each edge of adjacent panel sections. Again, the configuration and construction of the joints or connections between adjacent panel sections can vary within the spirit and scope of the present invention. FIG. 11 illustrates only one of many alternative suitable embodiments.

As shown in FIG. 5B, the bottom surface 40 of the mattress assembly 20 may be visible when folded around the collapsed playard 26 or other product. Thus, in another example the support structure, or at least the bottom surface 40, can be designed to have a particular desired appearance and configuration. The support structure can be designed to provide a unique appearance and protective function when folded around the collapsed playard unit 26. This could eliminate the need for a separate storage bag 46. The support structure can provide a "suitcase" appearance and provide a "hard shell" protective function for the folded unit 26, all the while reducing the weight of the portable product.

The mattress support structure 22, such as the panels 50*a* and 50*b*, and the mattress pad 24 are also designed in this example so that the pad can be easily removed from the support structure. Thus, the separate pad or cushion 24 can be easily removed for washing, cleaning, wiping, replacement, and the like. As shown in FIGS. 1 and 7-10, each of the panels in the disclosed example includes a plurality of mattress fasteners 80 and mattress flap slots 82. The two interior panels 50*a* each include only two flap slots 82, one formed near the edge of each of the short ends 54. The interior panels sections 50*a* also include only two fasteners 80, one spaced further inward from each of the short ends 54. Each of the end panels 50*b* includes an additional center mattress fastener 80 and an additional flap slot 82 centered along the outer long side 52. In the disclosed example, the mattress fasteners 80 are integrally formed as part of the panel sections 50*a* and 50*b*, but can be separate, discrete, detachable fasteners if desired. Each fastener in this example is surrounded by an annular rib 88 and sits in a depression 89 within the rib. The rib 88 creates rigidity and adds strength to the fastener structure in this example.

As shown in FIGS. 7 and 9, a plurality of fabric flaps 90 extend outward from the mattress pad 24 near the edges of the pad. The flaps 90 are numbered and positioned to correspond with the number and position of the flap slots 82 in the various panel sections 50*a* and 50*b*. Each of the flaps 90 terminates at a connector 92 coupled to the end of the flaps. The connectors 92 are configured to removably attach to the corresponding fasteners 82 on the various panel sections 50*a* and 50*b*. In this example, the connectors 92 can be integrally formed as part of the flaps 90 or can be attached in different ways from that shown and described herein. As will be evident to those having ordinary skill in the art, the configuration, location, quantity, arrangement, and size of the flaps, slots, connectors, and fasteners can vary and yet fall within the spirit and scope of the present invention.

In the disclosed example, each connector 92 is in the form of a ring 94 sewn to the end of a respective flap 90. Each of the rings 94 in the disclosed example has a slot 96 in the center of the ring. Each of the fasteners 80 on the panel sections is in the form of a stud having a head 84 coupled to a stem 86 that integrally connects the head to the panel. In the disclosed example, each head 84 has an elongate or oblong shape lying generally parallel to a plane of the support surface 64 on the panel section from which it extends. The size and shape of the head corresponds to the size and shape of the slots 96 in the rings 94. In the disclosed example, the orientation of each slot 96 in the rings 94 is offset relative to the orientation of the heads 84 on the fasteners 82. Thus, to attach a ring 94 to a fastener 80, the ring must be rotated to insert the head 84 through the slot. The ring will then return to its natural orientation with the slot offset from the head. The offset will assist in retaining the ring 94 will not easily detach from the connector to which it is attached. A user will need to manually rotate the ring 94 to realign the slot 96 and head 84 to remove the connector 92 from the fastener 80.

The mattress attachment devices can also vary from the example shown herein. The manner in which the devices secure the mattress pad 24 to the support structure 22 can vary and the manner in which the devices must be manipulated to attach or detach the pad can also vary. Certainly, the orientation of the slots 96 and heads 84 can be reversed or altered from that shown. Hook and loop fastener materials could be employed, straps could replace the flaps, snaps could be used, and other attachment device variations can fall within the spirit and scope of the present inventions. In an alternative example, the flaps 90 can have male connectors or other fastener types and the support structure can employ female connectors or other mating fastener devices as well. The flap slots in the side edges of the support structure can be completely absent or can be replaced by notches, cutouts, or other flap positioning and/or flap retaining features.

Figure 12:
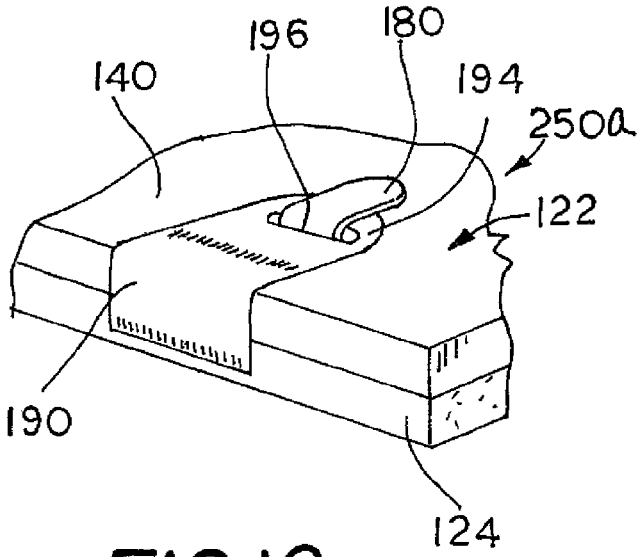
FIG. 12 shows an enlarged perspective bottom view of a portion of a mattress assembly with an alternative mattress pad to support structure attachment constructed in accordance with the teachings of the present invention.

FIG. 12 illustrates one alternative example of a connection arrangement for attaching a mattress pad 124 to the underlying support structure 122. In this example, the slots 82 and fasteners 80 are replaced by a simpler arrangement. Attachment flaps 190 extend from edges of the mattress pad 124 and again include a ring 194 with a lateral slot 196 in the ring. The flaps 190 overlie the edge of a given panel section 250*a* and extend over a portion of the bottom surface 140. An integral tongue 180 projects upward and then parallel along a portion of the bottom surface 140. The slot 196 slips over a free end of the tongue and is secured in place by tension in the mattress pad 124. Again, the mattress pad attachment components can vary and yet fall within the spirit and scope of the present invention. FIG. 12 illustrates only one of many alternative suitable embodiments.

The structure and features of the mattress pad 24 can also vary from the example shown and described herein. The padding material can be any suitable cushion material, can be provided as one large piece of material, can be provided in segments matching the panel sections, can be a unitary structure, can be layered, and the like. The mattress pad 24 could also be formed so that it is easily reversible so that a user could choose to expose and use either side. In one example, each side can have a different appearance, material, and the like so that reversing the pad can change the look, feel, and/or functionality of the mattress. The pad or cushion can be fabricated with an interior cushion material, such as fiberfill or foam filler, which can be covered with a washable fabric layer. This modular mattress system can also provide a user with the opportunity to increase the thickness of padding in or on the mattress, to repair or replace the padding or fabric cover, and the like.

As shown in FIGS. 1 and 2, the edges of the support structure 22 can extend beyond the perimeter edges of the cushion by placement of the flap slots. When the mattress is installed in a playard, bassinet or other product, these exposed edges can slip within a narrow opening around the edges of the product to assist in retaining the mattress in place when in use. Alternatively, the edges of the mattress pad 24 can align with the edges of the support structure 22, or can even overlap the edges of the support structure.

Although certain mattress assembly and contained child play area examples have been disclosed and described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A mattress assembly for a contained child play area, the mattress assembly comprising:

a mattress pad;

a plurality of mattress connectors coupled to the mattress pad;

a substantially rigid support structure having a plurality of panels coupled to one another and reconfigurable between a generally planar in-use configuration where the plurality of panels lie edge to edge adjacent one another defining an outer edge and a storage configuration different from the in-use configuration;

a plurality of retaining features positioned inboard of the outer edge; and a plurality of mating fasteners carried on the support structure, each mating fastener configured to removably couple with one of the plurality of mattress connectors removably attaching the mattress pad to the support structure, wherein a part of each of the plurality of mattress connectors extends through one of the plurality of retaining features of the support structure, and wherein the mattress assembly can be installed in and removed from a contained child play area and wherein the support structure is sized in the in-use configuration to generally underlie the mattress pad.

2. A mattress assembly according to claim 1, wherein the plurality of mattress connectors are carried on flaps extending from the mattress pad.

3. A mattress assembly according to claim 2, wherein each of the plurality of mattress connectors is a ring connected to a respective flap and a ring slot provided within the ring.

4. A mattress assembly according to claim 1, wherein each of the plurality of panels is a generally rectangular panel section.

5. A mattress assembly according to claim 1, wherein each of the plurality of panels is connected along at least one edge to another of the plurality of panels via a hinged joint and is pivotally movable about the hinged joint.

6. A mattress assembly according to claim 1, wherein the plurality of panels further comprises:

four plastic rectangular panel sections, each having a pair of opposed longer sides and a pair of opposed shorter ends; and hinge components carried on at least one of the longer sides of each panel section, wherein the four panel sections are arranged longer side to longer side adjacent one another and pivotally coupled together with the hinge components to form the support structure.

7. A mattress assembly according to claim 1, wherein each of the plurality of panels has a plurality of hinge pins and hinge knuckles alternately spaced along at least one edge of the panel for attachment to an adjacent one of the plurality of panels.

8. A mattress assembly according to claim 1, wherein each of the plurality of panels is a plastic molded panel and has a perforate support surface.

9. A mattress assembly according to claim 1, wherein each of the plurality of mating fasteners is a stud projecting from a bottom surface of one of the plurality of panels, each stud having a stem and a head coupled to the stem.

10. A mattress assembly according to claim 9, wherein each of the plurality of mattress connectors is a ring with a ring slot configured to slip over the head of one of the mating fasteners.

11. A mattress assembly according to claim 10, wherein the ring slots are elongate and the heads are oblong to match the shape of the ring slots, and wherein the ring slots are rotationally offset from the heads.

12. A mattress assembly according to claim 1, wherein each of the plurality of mating fasteners is a tongue projecting from and then parallel along but spaced from a bottom surface of one of the plurality of panels, each tongue having a free end.

13. A mattress assembly according to claim 12, wherein each of the plurality of mattress connectors is a ring with a ring slot configured to slip over the free end of the tongue of one of the plurality of mating fasteners.

14. A mattress assembly for a playard, the mattress assembly comprising:

a plurality of support panels coupled to one another and movable relative to one another between a generally planar in-use configuration having a top side, a bottom side, an outer edge, and a plurality of slots inboard of the outer edge, and a multi-sided storage configuration with an interior space sized to surround a collapsed playard;

a mattress pad detachable from and attachable to the plurality of support panels, the mattress pad lying against the top side of the plurality of support panels and movable with the plurality of support panels between the in-use configuration and the storage configuration; and a plurality of attachment devices for selectively attaching the mattress pad to and detaching the mattress pad from the plurality of support panels, wherein, when the mattress pad is attached to the plurality of support panels, parts of the plurality of attachment devices extend through the plurality of slots of the plurality of support panels and extend over a portion of the bottom side.

15. A mattress assembly according to claim 14, wherein the mattress pad is detachable from the top side of the plurality of support panels while the plurality of support panels remain coupled to one another.

16. A mattress assembly according to claim 14, wherein the mattress assembly can be selectively arranged in the multi-sided storage configuration with either the mattress pad or the plurality of support panels exposed to the outside.

17. A mattress assembly according to claim 14, wherein the plurality of support panels include hinge components along edges thereof, wherein the hinge components are configured and arranged to pivotally couple the plurality of support panels to one another.

18. A mattress assembly according to claim 17, wherein the hinge components are integrally molded on at least one edge of each of the plurality of support panels, and wherein the hinge components include alternating hinge pins and knuckles along each edge.

19. A playard comprising:

a frame assembly movable between an in-use configuration and a collapsed portable configuration;

a flexible material side wall supported by the frame assembly;

a bottom near a lower edge of the side wall, the bottom and side wall being collapsible with the frame assembly;

a contained area formed within the confines of the side wall and above the bottom in the in-use configuration; and a mattress assembly that can lie flat and fit within the contained area on the bottom when the frame assembly is in the in-use configuration and that can be removed and reconfigured to surround the frame assembly when in the collapsed configuration, wherein the mattress assembly has a plurality of support panels coupled to one another and movable relative to one another and having a top side and a bottom side when lying flat and together defining an outer edge and having a plurality of attachment device retaining features positioned inboard of the outer edge, a mattress pad detachable from and attachable to the plurality of support panels, the mattress pad lying against the top side of the plurality of support panels, and a plurality of attachment devices for selectively attaching the mattress pad to and detaching the mattress pad from the plurality of support panels, the plurality of attachment devices received in the plurality of attachment device retaining features when the mattress pad is attached to the plurality of support panels.

20. A playard according to claim 19, wherein the mattress pad is detachable from the top side of the plurality of support panels while the plurality of support panels remain coupled to one another.

* * * * *